US010177480B2

(12) United States Patent
Choi et al.

(10) Patent No.: US 10,177,480 B2
(45) Date of Patent: Jan. 8, 2019

(54) HIGH-VOLTAGE CONNECTOR AND HIGH-VOLTAGE POWER SUPPLY CONNECTING DEVICE HAVING THE SAME

(71) Applicant: LS EV KOREA LTD., Gunpo-si, Gyeonggi-do (KR)

(72) Inventors: Jeong Hyeok Choi, Anyang-si (KR); Moon Kyu Jang, Suwon-si (KR); Seung Hyun Lee, Daegu (KR)

(73) Assignee: LS EV KOREA LTD., Gunpo-Si, Gyeonggi-Do (KR)

( * ) Notice: Subject to any disclaimer, the term of this patent is extended or adjusted under 35 U.S.C. 154(b) by 0 days.

(21) Appl. No.: 15/831,923

(22) Filed: Dec. 5, 2017

(65) Prior Publication Data

US 2018/0166818 A1 Jun. 14, 2018

(30) Foreign Application Priority Data

Dec. 9, 2016 (KR) ..... 10-2016-0167623

(51) Int. Cl.

| | |
|---|---|
| ***H01R 13/627*** | (2006.01) |
| ***H01R 13/629*** | (2006.01) |
| ***H01R 13/707*** | (2006.01) |
| ***H01R 13/53*** | (2006.01) |
| ***H01R 13/436*** | (2006.01) |
| ***H01R 13/213*** | (2006.01) |
| ***H01R 13/703*** | (2006.01) |

(52) U.S. Cl.

CPC ..... *H01R 13/213* (2013.01); *H01R 13/4362* (2013.01); *H01R 13/6275* (2013.01); *H01R 13/62927* (2013.01); *H01R 13/7036* (2013.01); *H01R 13/707* (2013.01)

(58) Field of Classification Search

CPC ..... H01R 13/62927; H01R 13/53; H01R 13/707; H01R 13/7036; H01R 13/6275; H01R 13/4362

See application file for complete search history.

(56) References Cited

U.S. PATENT DOCUMENTS 5,692,923 A * 12/1997 Sawada ..... H01R 13/6272 439/350
5,820,409 A * 10/1998 Clark ..... H01R 13/424 439/595
6,491,542 B1 * 12/2002 Zerebilov ..... H01R 13/4226 439/352

(Continued)

FOREIGN PATENT DOCUMENTS

WO WO 2014073784 A1 * 5/2014 ..... H01R 13/6275

*Primary Examiner* — Briggitte R Hammond
(74) *Attorney, Agent, or Firm* — K&L Gates LLP

(57) ABSTRACT

The present invention relates to a connector which is a component of a high-voltage power supply connecting device, and which is capable of being prevented from being easily separated inadvertently or by an inexpert operator to prevent the occurrence of an electric shock accident, is capable of preventing the occurrence of an electric arc or the like during separation of the connector to improve safety, is capable of being easily and stably fixed and mounted on a desired location in an installation path inside an electric equipment chamber of an electric car, has a simple structure, and is capable of improving workability of an operator; and the high-voltage power supply connecting device including the same.

18 Claims, 10 Drawing Sheets

(56) References Cited

U.S. PATENT DOCUMENTS

| | | | | |
|---|---|---|---|---|
| 7,381,084 | B1 * | 6/2008 | Horn | H01R 13/6272 439/350 |
| 7,641,499 | B1 * | 1/2010 | George | B60L 3/0069 439/352 |
| 8,192,212 | B2 * | 6/2012 | Casses | B60L 11/1818 439/181 |
| 8,708,731 | B2 * | 4/2014 | Chatelus | H01R 13/6271 439/350 |
| 2001/0027058 | A1 * | 10/2001 | Pederson | H01R 13/6272 439/595 |
| 2017/0271815 | A1 * | 9/2017 | Lane | H01R 13/6272 |

* cited by examiner

HIGH-VOLTAGE CONNECTOR AND HIGH-VOLTAGE POWER SUPPLY CONNECTING DEVICE HAVING THE SAME

CROSS REFERENCE TO PRIOR APPLICATION

This application claims priority to Korean Patent Application No. 10-2016-0167623 (filed on Dec. 9, 2016), which is hereby incorporated by reference in its entirety.

BACKGROUND OF THE INVENTION

Field of the Invention

The present invention relates to a connector and a high-voltage power supply connecting device including the same. More particularly, the present invention relates to a connector which is a component of a high-voltage power supply connecting device, and which is capable of being prevented from being easily separated inadvertently or by an inexpert operator to prevent the occurrence of an electric shock accident, is capable of preventing the occurrence of an electric arc or the like during separation of the connector to improve safety, is capable of being easily and stably fixed and mounted on a desired location in an installation path inside an electric equipment chamber of an electric car, has a simple structure, and is capable of improving workability of an operator; and the high-voltage power supply connecting device including the same.

Background Art

Generally, a high-voltage connector which is a component of a high-voltage power supply connecting device includes a high-voltage power terminal for supplying power and an interlock terminal for selectively blocking the supply of power from the high-voltage power terminal to prevent the occurrence of an electric arc in the high-voltage power terminal during disconnection of the connector.

The interlock terminal is provided to transmit a signal for supplying high-voltage power via a high-voltage power cable and blocking the supply of the high-voltage power.

During installation of a pair of corresponding connectors of the high-voltage power supply connecting device, power is supplied via high-voltage power terminals of the pair of connectors in a state in which all high-voltage power terminals and interlock terminals of the pairs of connectors are connected.

In order to prevent the occurrence of an electric arc at the high-voltage power terminals during the disconnection of a first conductor and a second connector of the high-voltage power supply connecting device, interlock terminals of the first and second connectors are disconnected from each other and then the supply of high-voltage power to high-voltage power terminals is blocked when an interlock connection state is canceled through the disconnection of the interlock terminals.

Thus, the occurrence of an electric arc during disconnection of the high-voltage power terminals may be prevented by blocking the supply of power to the high-voltage power terminals before the high-voltage power terminals is physically disconnected from each other.

That is, for the disconnection of the connectors, the supply of high-voltage power is blocked after the interlock terminals are disconnected and then the high-voltage power terminals are disconnected while the supply of high-voltage power is blocked, thereby reducing a probability of the occurrence of an electric arc.

The 2-step disconnection method may be implemented by differently setting connection lengths of connection terminals during the disconnection of the connectors. That is, during the disconnection of the connectors connected to each other, the high-voltage power terminals may be disconnected a predetermined time after the disconnection of the interlock terminals when a length of connection between the high-voltage power terminals is set to be longer than that of connection between the interlock terminals. Accordingly, the above-described problem can be solved when the supply of power to the high-voltage power terminals is blocked by disconnecting the connection terminals at different times.

However, an amount of time needed for the disconnection of the connectors may vary according to an operator. If the disconnection of the connectors is extremely quickly performed, the supply of high-voltage power to the high-voltage power terminals may not be blocked before the high-voltage power terminals are disconnected after the disconnection of the interlock terminals. Thus, the occurrence of an electric arc cannot be prevented using different connection lengths of the connection terminals.

Alternatively, a physical locking structure may be employed for disconnection of interlock terminals and high-voltage power terminals, in which a locked state should be released as a precondition for disconnection of connection terminals.

The physical locking structure may include a locking protrusion, an unlocking button, etc. The unlocking button is, however, configured to be easily pressed and thus the interlock terminals and the high-voltage power terminals are likely to be disconnected inadvertently or due to an unskilled user's curiosity. Thus, the physical locking structure is disadvantageous in terms of the risk of a safety accident and reliability.

Generally, since a high-voltage connector and a high-voltage power supply connecting device including the same are installed in an electric equipment space of an electric car or a hybrid car, they may be continuously leaned to one side and exposed to vibration and are thus preferably stably fixed on a desired location. Even if the high-voltage power supply connecting device includes a fixing means for fixing the high-voltage power supply connecting device inside an electric equipment chamber, the fixing means need to be configured not to interrupt disconnection or engagement of connectors of the high-voltage power supply connecting device.

SUMMARY OF THE INVENTION

The present invention is directed to a connector which is a component of a high-voltage power supply connecting device, and which is capable of being prevented from being easily disconnected inadvertently or by an inexpert operator to prevent the occurrence of an electric shock accident, is capable of preventing the occurrence of an electric arc or the like during disconnection of the connector to improve safety, is capable of being easily and stably fixed and mounted on a desired location in an installation path inside an electric equipment chamber of an electric car, has a simple structure, and is capable of improving workability of an operator; and the high-voltage power supply connecting device including the same.

To achieve these objects, the present invention provides a connector which is a component of connectors of a high-voltage power supply connecting device having interlock terminals and high-voltage power terminals and which is one of a pair of connectors to be connected to each other, the connector comprising a housing configured to mount therein the high-voltage power terminal, an interlock connection part provided at an outer side of the housing, and including one of the interlock terminals, an interlocking means configured to selectively lock or unlock a connection state between interlock terminals of the pair of connectors, a high-voltage locking means configured to selectively lock or unlock a connection state between high-voltage power terminals of the pair of connectors and a preliminary locking means configured to selectively block unlocking of the interlocking means, wherein the high-voltage locking means, the interlocking means, and the preliminary locking means are arranged in a line on a manipulation part provided on the housing, and during disconnection of the pair of connectors of the high-voltage power supply connecting device, the interlock terminals are disconnected before disconnection of the high-voltage power terminals, and the supply of power to the high-voltage power terminals is blocked when the interlock terminals are disconnected from each other.

And the interlock connection part may be integrally formed with a bottom surface of the housing.

And while the pair of connectors of the high-voltage power supply connecting device are connected to each other, the pair of connectors may be separable from each other after a preliminary locked state, an interlocked state, and a high-voltage locked state for the other connector are sequentially released through the preliminary locking means, the interlocking means, and the high-voltage locking means of the connector.

And the interlocking means may comprises a first locking protrusion formed in a downward direction, and configured to be locked by a first stopper protrusion protruding upward from a surface of a housing of the other connector to be connected to the connector; and a first unlocking button configured to selectively release a locked state of the first locking protrusion, wherein the first locking protrusion and the first unlocking button are integrally formed with an upper part of the housing of the connector.

And while the first unlocking button is pressed, the interlock terminals may be disconnected from each other by pulling out the housing of the connector by a predetermined distance in a direction of disconnection of the connector.

And the high-voltage locking means comprises a second locking protrusion formed in a downward direction, and configured to be locked by a second stopper protrusion protruding upward from a surface of the housing of the other connector to be connected to the connector; and a second unlocking button configured to selectively release a locked state of the second locking protrusion, wherein the second locking protrusion and the second unlocking button are integrally formed with the upper part of the housing, and the predetermined distance is a distance between stepped surfaces of the first locking protrusion and the second locking protrusion.

And when the first unlocking button or the second unlocking button is pressed, the first locking protrusion locked by the first stopper protrusion or the second locking protrusion locked by the second stopper protrusion may be lifted according to the principle of the lever and thus the interlocked state or the high-voltage locked state is released.

And the preliminary locking means may comprise a preliminary locking member located below the first unlocking button of the interlocking means to prevent downward movement of the first unlocking button when the first unlocking button is pressed while the pair of connectors of the high-voltage power supply connecting device are connected to each other, the preliminary locking member configured to be inserted to a location at which the downward movement of the first unlocking button is not permitted or be pulled out to a location at which the downward movement of the first unlocking button is permitted.

And the preliminary locking member may be mounted to be slidingly inserted into or pulled out from an installation slot formed in the upper part of the housing of the connector.

And the connector may comprise a grip part configured to grip the preliminary locking member during insertion or pulling out of the preliminary locking member, the grip part being formed at an end part of the preliminary locking member facing a direction in which the preliminary locking member is pulled out.

And the preliminary locking member may comprise a stopper at a center region thereof, the stopper being provided in a barrier form with a step facing a direction in which the preliminary locking member is pulled out, and the first unlocking button comprises a flange configured to be stopped by the stopper to prevent the preliminary locking member from being separated from the connector, the flange provided at a front end of a portion of the first unlocking button on which pressure is applied, wherein the stopper and the flange prevent the preliminary locking member from being pulled out by more than a predetermined distance.

And the preliminary locking member may comprise a dent behind the stopper; and an uplifted part behind the dent, wherein the uplifted part prevents downward movement of the first unlocking button while the preliminary locking member is inserted, and the dent provides a space for downward movement of the first unlocking button while the preliminary locking member is pulled out.

And the second unlocking button and the first unlocking button may be arranged in a line at a center of the manipulation part in a direction in which the preliminary locking member is inserted or a direction in which the preliminary locking member is pulled out, and the preliminary locking member is inserted or pulled out behind the first unlocking button.

And to achieve these objects, the present invention provides A high-voltage power supply connecting device including a pair of connectors, the high-voltage power supply connecting device comprising: a first connector comprising a first interlock terminal; a first high-voltage power terminal; a housing configured to mount therein the first high-voltage power terminal; a first interlock connection part located at an outer side of the housing, and including the first interlock terminal; an interlocking means configured to selectively lock or unlock a connection state of the first interlock terminal; a high-voltage locking means configured to selectively lock or unlock a connection state of the first high-voltage power terminal; and a preliminary locking means including a preliminary locking member mounted to slidingly inserted or pulled out so as to selectively block unlocking of the interlocking means; and a second connector comprising a second interlock terminal; a second high-voltage power terminal; a second housing configured to mount therein the second high-voltage power terminal, the second housing including stopper protrusions configured to lock locking protrusions of the interlocking means and the high-voltage locking means of the first connector; a fixing unit configured to fix the high-voltage power supply connecting device in an electric equipment space of an electric car, the fixing unit being included in the second housing; and a second interlock connection part located at an outer side of the second housing, and including the second interlock terminal, wherein the high-voltage locking means, the interlocking means, and the preliminary locking means of the first connector are arranged in a line on a manipulation part provided on the housing, and during disconnection of the first and second connectors, the first and second interlock terminals are disconnected from each other before disconnection of the first and second high-voltage power terminals, and the supply of power to the first and second high-voltage power terminals is blocked when the first and second interlock terminals are disconnected from each other.

And the first and second interlock connection parts may be respectively integrally formed with a bottom surface of the first housing and a bottom surface of the second housing.

And while the first and second connectors may be connected to each other, the first and second connectors are separable from each other after a preliminary locked state, an interlocked state, and a high-voltage locked state for the second connector are sequentially released through the preliminary locking means, the interlocking means, and the high-voltage locking means of the first connector.

And the fixing unit of the second connector may comprise a fixing clip configured to be attachable to or detachable from the second housing.

And the fixing clip may be mounted on a side surface of the second housing.

DETAILED DESCRIPTION

Hereinafter, exemplary embodiments of the present invention will be described in detail with reference to the accompanying drawings. The present invention may, however, be embodied in many different forms and should not be construed as limited to the embodiments set forth herein. Rather, these embodiments are provided so that this disclosure will be thorough and complete, and fully convey the scope of the invention to those skilled in the art. Throughout the specification, the same reference numbers may be used to denote similar components in various embodiments.

Figure 1:
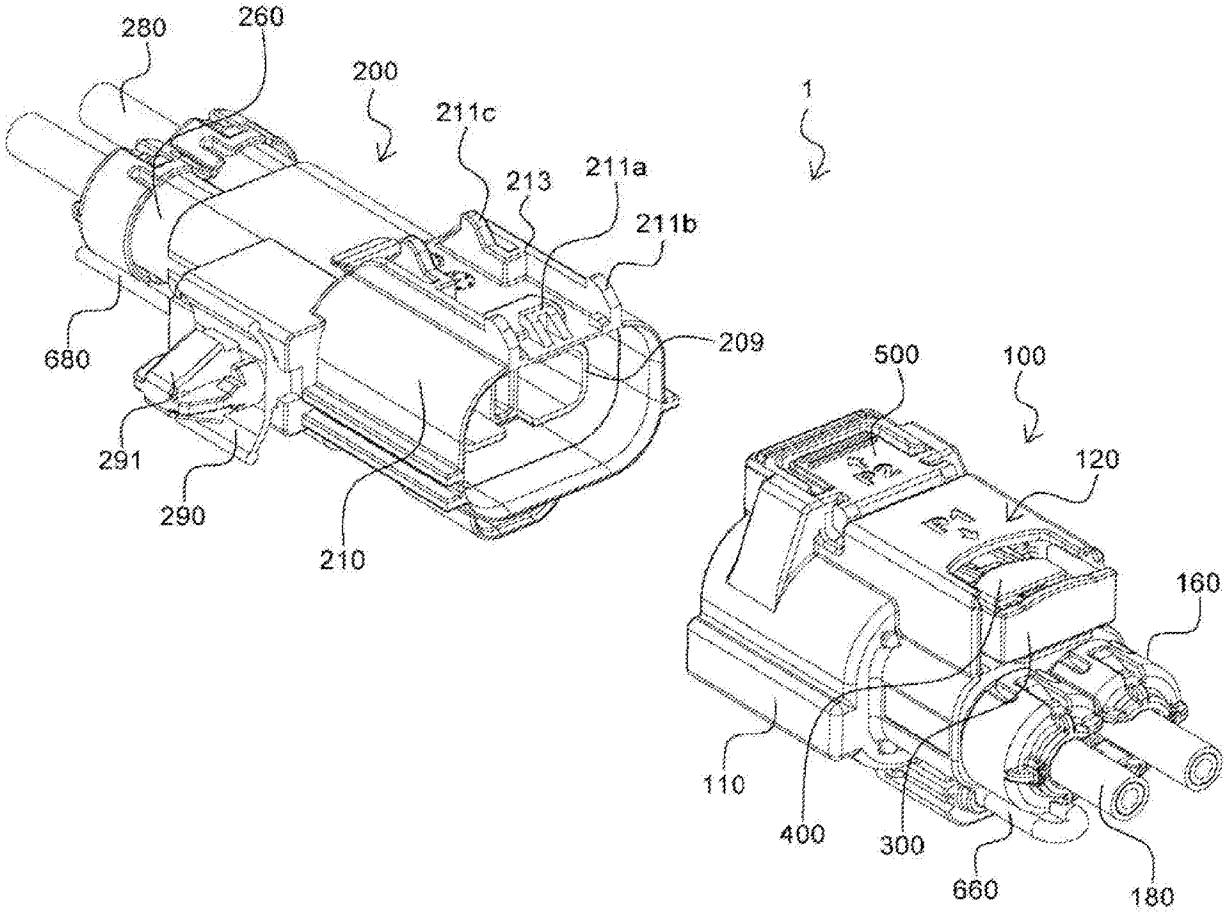
FIG. 1 is a perspective view of a disconnected state between a first connector of a high-voltage power supply connecting device and a second connector to be connected to the first connector, according to an embodiment of the present invention.

FIG. 1 is a perspective view of a disconnected state between a first connector 100 and a second connector 200 of a high-voltage power supply connecting device 1, according to an embodiment of the present invention.

The high-voltage power supply connecting device 1 according to an embodiment of the present invention is a high-voltage power supply connecting device having a pair of connectors, and includes the first connector 100 having a first interlock terminal, a first high-voltage power terminal, a first housing configured to mount therein the first high-voltage power terminal, a first interlock connection part provided on an outer side of the first housing and having the first interlock terminal, an interlocking means configured to selectively lock or unlock a connection state of the first interlock terminal, a high-voltage locking means configured to selectively lock or unlock a connection state of the first high-voltage power terminal, and a preliminary locking means having a preliminary locking member mounted to be slidingly inserted or pulled out so as to selectively block unlocking of the interlocking means; and the second connector 200 having a second interlock terminal, a second high-voltage power terminal, a second housing configured to mount therein the second high-voltage power terminal and having stopper protrusions configured to lock locking protrusions of the interlocking means and the high-voltage locking means of the first connector 100, a fixing unit 290 included in the second housing to fix the high-voltage power supply connecting device 1 in an electric equipment space of an electric car, and a second interlock connection part provided on an outer side of the second housing and having the second interlock terminal. The high-voltage locking means, the interlocking means and the preliminary locking means of the first connector 100 are provided in a line on a manipulation part 120 provided on the first housing 110, and are configured to disconnect the first and second interlock terminals from each other before disconnection of the first and second high-voltage power terminals and block the supply of power to the first and second high-voltage power terminals when the first and second interlock terminals are disconnected from each other, during disconnection of the first and second connectors 100 and 200.

The high-voltage power supply connecting device 1 according to an embodiment of the present invention may include the first and second connectors 100 and 200 which are in corresponding forms. For convenience of explanation, connectors which are in corresponding forms will be referred to as the first connector 100 and the second connector 200.

The first connector 100 and the second connector 200 of the high-voltage power supply connecting device 1 according to an embodiment of the present invention may be constructed such that high-voltage power cables 180 and 280 are respectively coupled thereto.

The high-voltage power cables 180 and 280 may be connected to the high-voltage power terminals of the first connector 100 and the second connector 200 (see reference numerals 130*a*, 130*b*, 230*a* and 230*b* of FIGS. 2 and 3) via cable installation holes 160 and 260 of the first connector 100 and the second connector 200. The interlock terminals (not shown) may be connected to a signal transmission cable 680 or the like.

The first connector 100 of the high-voltage power supply connecting device 1 according to an embodiment of the present invention includes the first housing 110 having the manipulation part 120 thereon. The manipulation part 120 may include an unlocking button, etc. to safely and sequentially disconnect the first and second connectors 100 and 200. The unlocking button will be described in detail below.

The first and second connectors 100 and 200 of the high-voltage power supply connecting device 1 illustrated in FIG. 1 may be in a detachable form. However, when the first and second connectors 100 and 200 are suddenly disconnected from each other while high-voltage power is supplied thereto, an electric arc or the like may occur and thus the components of the high-voltage power supply connecting device 1 may be damaged or a safety accident may occur. To prevent this problem, a connector according to an embodiment of the present invention employs a method of perform locking step by step and selectively releasing a locked state in each stage through an operator's manipulation.

The first connector 100 of the high-voltage power supply connecting device 1 illustrated in FIG. 1 may include the interlocking means for locking a connection state between the interlock terminals while the high-voltage power terminals are connected and the interlock terminals are connected, and the high-voltage locking means for disconnecting the high-voltage power terminals from each other while the interlock terminals are disconnected from each other.

The first connector 100 of the high-voltage power supply connecting device 1 illustrated in FIG. 1 may further include a preliminary locking member 300 serving as a preliminary locking means to prevent a locked state of the interlocking means from being mistakenly unlocked, as will be described in detail below.

The interlock means or the high-voltage locking means of the first connector 100 may include locking protrusions (not shown) locked when stopped by stopper protrusions 211*a* and 211*b* of the second housing 210 of the second connector 200, and unlocking buttons 400 and 500 for selectively unlocking the locking protrusions.

The second connector 200 of FIG. 1 to be connected to the first connector 100 includes the second housing 210 configured to mount therein the first connector 100. The second housing 210 may include the stopper protrusions 211*a* and 211*b* for interlock connection locking or high-voltage connection locking the first connector 100.

In the embodiment of FIG. 1, the two protrusions 211*a* and 211*b* are provided on a top surface of the second housing 210 of the second connector 200. The two stopper protrusions 211*a* and 211*b* include the first stopper protrusion 211*a* for interlocking and the second stopper protrusion 211*b* for high-voltage locking.

The first stopper protrusion 211*a* and the second stopper protrusion 211*b* on the top surface of the second housing 210 of the second connector 200 each have an inclined plane in a direction in which the first connector 100 is connected to the second connector 200, and a vertical plane in a direction in which the first connector 100 is disconnected from the second connector 200. Thus, the first and second connectors 100 ad 200 may be connected to each other without being stopped or locked but may be locked by the stopper protrusions 211*a* and 211*b* when disconnection thereof is attempted.

As illustrated in FIG. 1, the first stopper protrusion 211*a* and the second stopper protrusion 211*b* are provided at similar locations in the direction in which first and second connectors 100 and 200 are connected to each other or the direction in which the first and second connectors 100 and 200 are disconnected from each other. However, the locations of the first housing 110 and the second housing 210 at which the locking protrusions are locked by the first and second stopper protrusions 211*a* and 211*b* are different, as will be described below.

Figure 2:
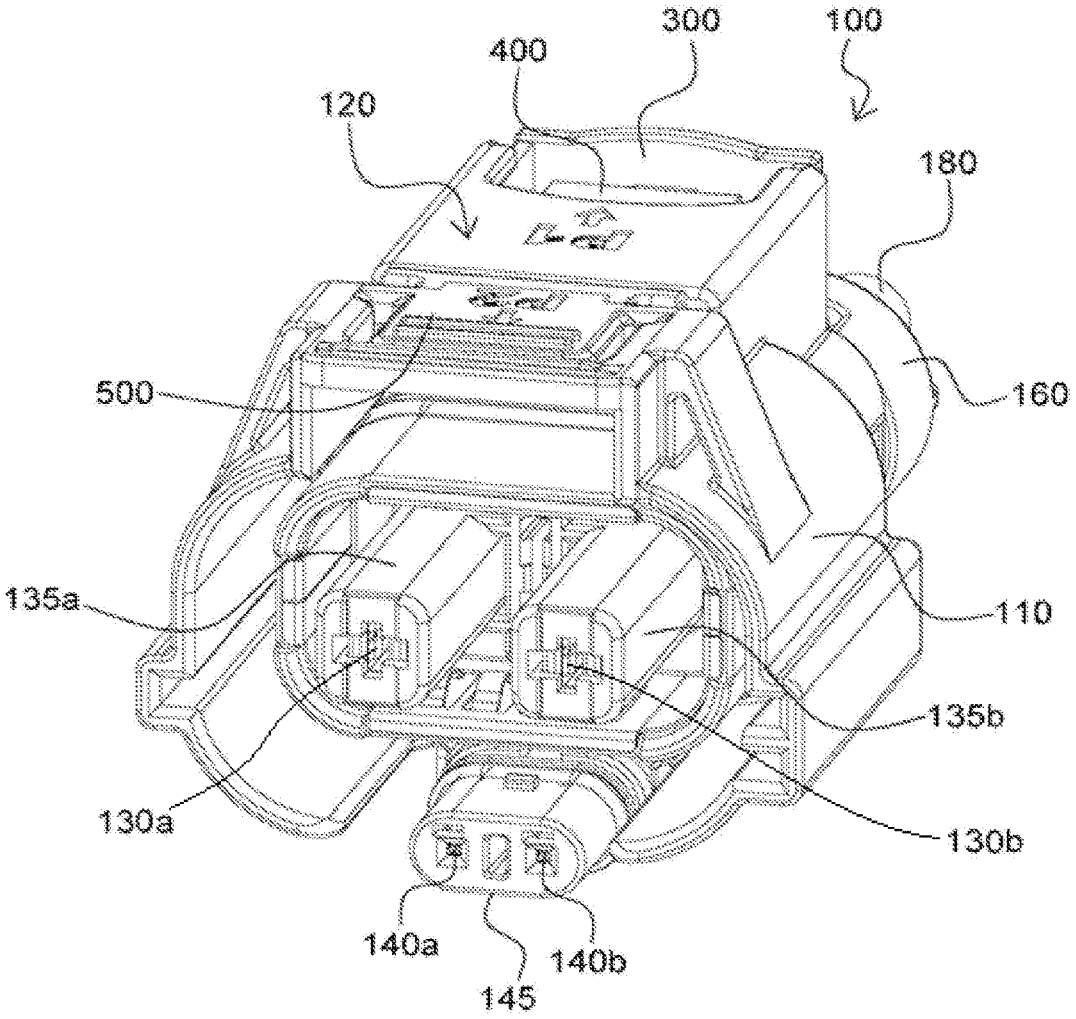
FIG. 2 is a front perspective view of the first connector of FIG. 1.
Figure 3:
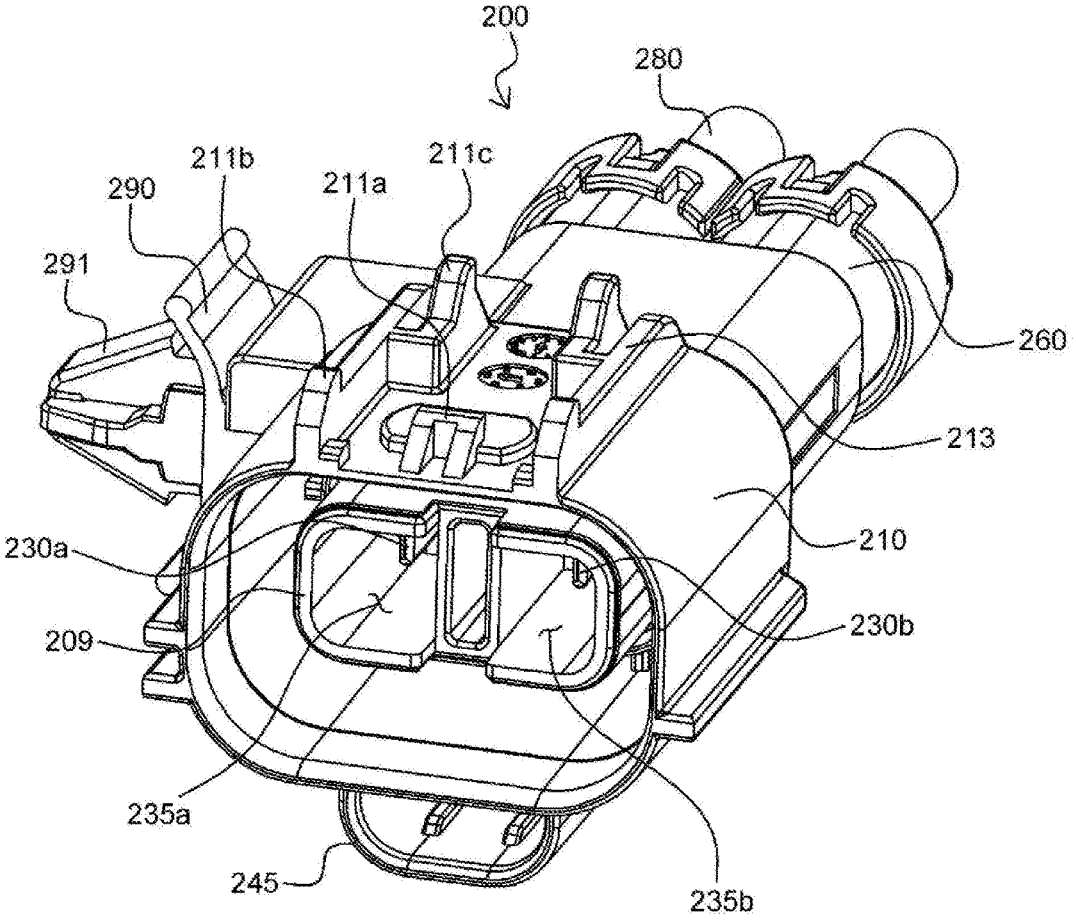
FIG. 3 is a front perspective view of the second connector of FIG. 1.

FIGS. 2 and 3 are front perspective views of a first connector 100 and a second connector 200 according to an embodiment of the present invention. In detail, FIG. 2 is a front perspective view of the first connector 100, and FIG. 3 is a front perspective view of the second connector 200.

The first connector 100 and the second connector 200 according to an embodiment of the present invention include interlock terminals and high-voltage power terminals.

The first connector 100 and the second connector 200 may further include the interlock terminals configured to block the supply of power to the high-voltage power terminals before the high-voltage power terminals are disconnected. The interlock terminals may be first disconnected from each other when the first and second connectors 100 and 200 are disconnected from each other. To this end, the interlock terminals may be first disconnected from each other to disconnect the first and second connectors 100 and 200 from each other. As the interlock terminals are disconnected, a time period for blocking the supply of power to the high-voltage power terminals may be secured and the occurrence of an electric arc may be prevented regardless of a speed of disconnecting the interlock terminals by an operator.

The first connector 100 of FIG. 2 includes a pair of first high-voltage power terminals 130*a* and 130*b* at left and right sides thereof. Similarly, the second connector 200 may further include a pair of second high-voltage power terminals 230*a* and 230*b* to be connected to the high-voltage power terminals of the first connector 100.

The high-voltage power terminals 130*a*, 130*b*, 230*a* and 230*b* of the first and second connectors 100 and 200 may be divided into male or female type terminals according to shapes thereof. In the embodiment of FIG. 2, the first high-voltage power terminals 130*a* and 130*b* are female type terminals and the second high-voltage power terminals 230*a* and 230*b* are male type terminals, but the first high-voltage power terminals 130*a* and 130*b* may be male type terminals and the second high-voltage power terminals 230*a* and 230*b* may be female type terminals.

The interlock terminals of the first connector 100 and the second connector 200 of FIGS. 2 and 3 may be mounted into first and second interlock connection parts 145 and 245 provided at outer sides of the first housing 110 and the second housing 210 other than inside the first housing 110 and the second housing 210. The first and second interlock connection parts 145 and 245 may be respectively integrally formed with lower parts (i.e., bottom surfaces) of the first and second housings 110 and 210 of the first and second connectors 100 and 200.

By providing the first and second interlock connection parts 145 and 245 at the outer sides of the first and second housings 110 and 210 other than center parts of the first and second housings 110 and 210, connectors having an interlock function may be configured if necessary even when an interlock signal transmission cable is not included in a high-voltage cable.

This is because when the first and second interlock connection parts 145 and 245 are provided at the center parts of the first and second housings 110 and 210, each high-voltage cable should include an interlock signal transmission cable with an interlock function.

The first and second interlock connection parts 145 and 245 may be respectively integrally formed with outer sides of the first housing 110 and the second housing 210, and particularly, the bottom surfaces of the first housing 110 and the second housing 210 as illustrated in FIGS. 2 and 3. Similarly, a pair of the interlock terminals may be provided, and may be a female type terminal and a male type terminal.

First interlock terminals 140*a* and 140*b* of the first connector 100 are female type terminals in the embodiment of FIG. 2 and second interlock terminals (not shown in FIG. 3) are male type terminals, and vice versa.

When the second connector 200 is a connector adjacent to a device (e.g., a power supply device), the first interlock terminals 140*a* and 140*b* of the first connector 100 may form a closed circuit and thus an interlock signal transmission cable 660 connected to the first interlock terminals 140*a* and 140*b* may be simply connected according to a method of forming a closed circuit connecting the first interlock terminals 140*a* and 140*b*. In contrast, the second interlock terminals of the second connector 200 may be connected to a control circuit for determining whether interlock connection is formed or not such that the supply of power via the high-voltage power terminals is blocked according to a connection state of a terminal.

The first connector 100 may include a pair of guide parts 135*a* and 135*b* to protect the high-voltage power terminals and guide a connector installation process. An inner housing 209 into which the pair of guide parts 135*a* and 135*b* of the first connector 100 are inserted and accommodated may be provided in the second connector 200.

The pair of the guide parts 135*a* and 135*b* may have prominent structures in which the pair of the first high-voltage power terminals 130*a* and 130*b* are accommodated.

The pair of the guide parts 135*a* and 135*b* of the first connector 100 having the above-described structure may be guided and inserted into guide grooves 235*a* and 235*b* of the second connector 200 during connection of the first connector 100 and the second connector 200.

As described above, in high-voltage power terminals and interlock terminals of connectors according to the present invention, when the connectors are separated from each other, the high-voltage power terminals are disconnected from each other after the interlock terminals of the connectors are disconnected from each other to block the supply of power.

In the high-voltage power terminals and the interlock terminals of the connectors according to the present invention, even during connection of the connectors, connection lengths of the interlock terminals may be set to be shorter so that the interlock terminals may be connected after connection of the high-voltage power terminal. Thus, power may be supplied to the high-voltage power terminals after communication of the interlock terminals is started.

Thus, connection lengths of the high-voltage power terminals 130*a*, 130*b*, 230*a* and 230*b* of the connectors 100 and 200 according to an embodiment of the present invention illustrated in FIGS. 2 and 3 may be set to be longer than those of the interlock terminals.

Here, the connection lengths of the terminals are defined as lengths at which connection states of the terminals are maintained during the connection or disconnection of the connectors 100 and 200.

During the disconnection of the connectors 100 and 200, disconnection of the high-voltage power terminals 130*a*, 130*b*, 230*a* and 230*b* should be later than that of the interlock terminals. Thus, in the connectors 100 and 200 of FIGS. 2 and 3 according to an embodiment of the present invention, the connection lengths of the high-voltage power terminals 130*a*, 130*b*, 230*a* and 230*b* are set to be longer than those of the interlock terminals so that the high-voltage power terminals may be disconnected after the supply of power via the high-voltage power terminals is blocked by blocking communication between the interlock terminals, thereby preventing the occurrence of sparks or the like during disconnection of the connectors 100 and 200.

Furthermore, even if an operator hurries to disconnect the connectors 100 and 200 from each other, the high-voltage power terminals 130*a*, 130*b*, 230*a* and 230*b* are locked and thus a certain amount of time is needed to unlock the high-voltage power terminals 130*a*, 130*b*, 230*a* and 230*b* after the disconnection of the interlock terminals, as will be described. Thus, a sufficient time required to block the supply of high-voltage power to these high-voltage power terminals may be secured, thereby guaranteeing safety.

Thus, the interlock terminals may be connected to each other after connection of the high-voltage power terminals 130*a*, 130*b*, 230*a* and 230*b* in a process of connecting the connectors 100 and 200 illustrated in FIG. 1, and the high-voltage power terminals 130*a*, 130*b*, 230*a* and 230*b* may be disconnected from each other after disconnection of the interlock terminals in a process of disconnecting the connectors 100 and 200 from each other. Thus, the connection of the interlock terminals may be set as a condition of supplying high-voltage power, and the disconnection of the interlock terminals may be set as a condition of blocking the supply of power to the high-voltage power terminals 130*a*, 130*b*, 230*a* and 230*b*.

As described above, in order to guarantee secure connection and disconnection of connectors, the high-voltage power supply connecting device 1 according to an embodiment of the present invention may include a preliminary locking means, the interlocking means, the high-voltage locking means, etc. to sequentially disconnect the terminals.

As illustrated in FIG. 3, the second connector 200 of the high-voltage power supply connecting device according to an embodiment of the present invention includes a fixing unit 290 of the second housing 210 to fix the high-voltage power supply connecting device in an electric equipment space of an electric car. The fixing unit 290 may be a fixing clip configured to be attachable to or detachable from the second housing 210 of the second connector 200. As illustrated in FIG. 3, the fixing clip may be mounted on a side surface of the second housing 210. The high-voltage power supply connecting device 1 may be very easily installed in an electric equipment space of an electric car through engagement of the fixing clip with a corresponding clip installed, for example, on a surface of a wall of the electric equipment space of the electric car. The fixing clip may be easily separated from the corresponding clip when needed.

Furthermore, as illustrated in FIG. 3, the fixing clip may be mounted on the side surface of the second housing 210 to avoid interference of the interlock connection parts of the second housing 210 and not to interrupt the manipulation of the manipulation part 120 of the first connector 100 as much as possible during the connection of the second connector 200 and the first connector 100.

Each of the connectors 100 and 200 of FIGS. 2 and 3 may include a sealing member (not shown) provided in the housing or the interlock connection parts thereof, and may further include a shield member (not shown) to shield electromagnetic waves in the housing thereof.

Figure 4:
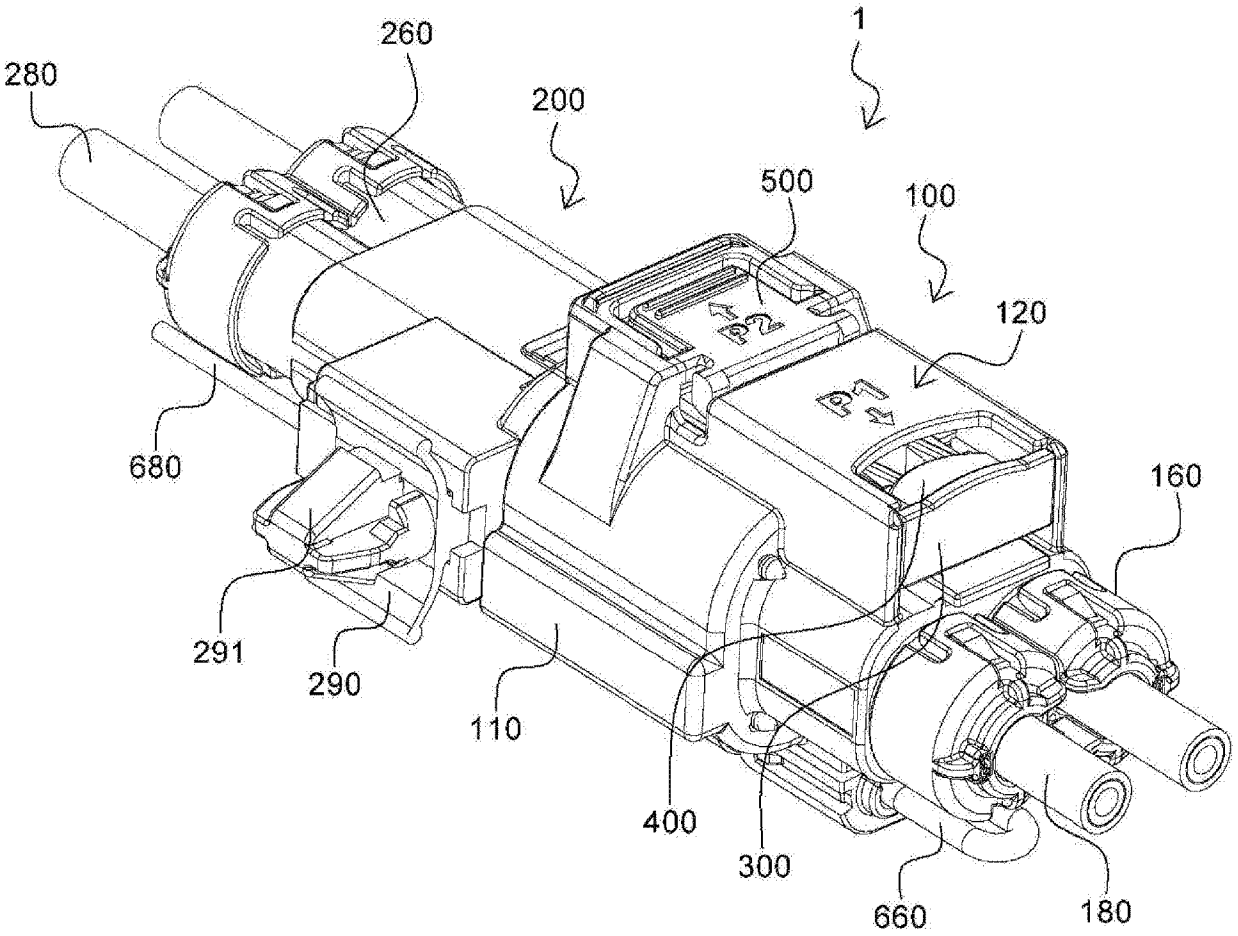
FIG. 4 is a perspective view of a connected state between a first connector and a second connector of a high-voltage power supply connecting device according to an embodiment of the present invention.
Figure 5:
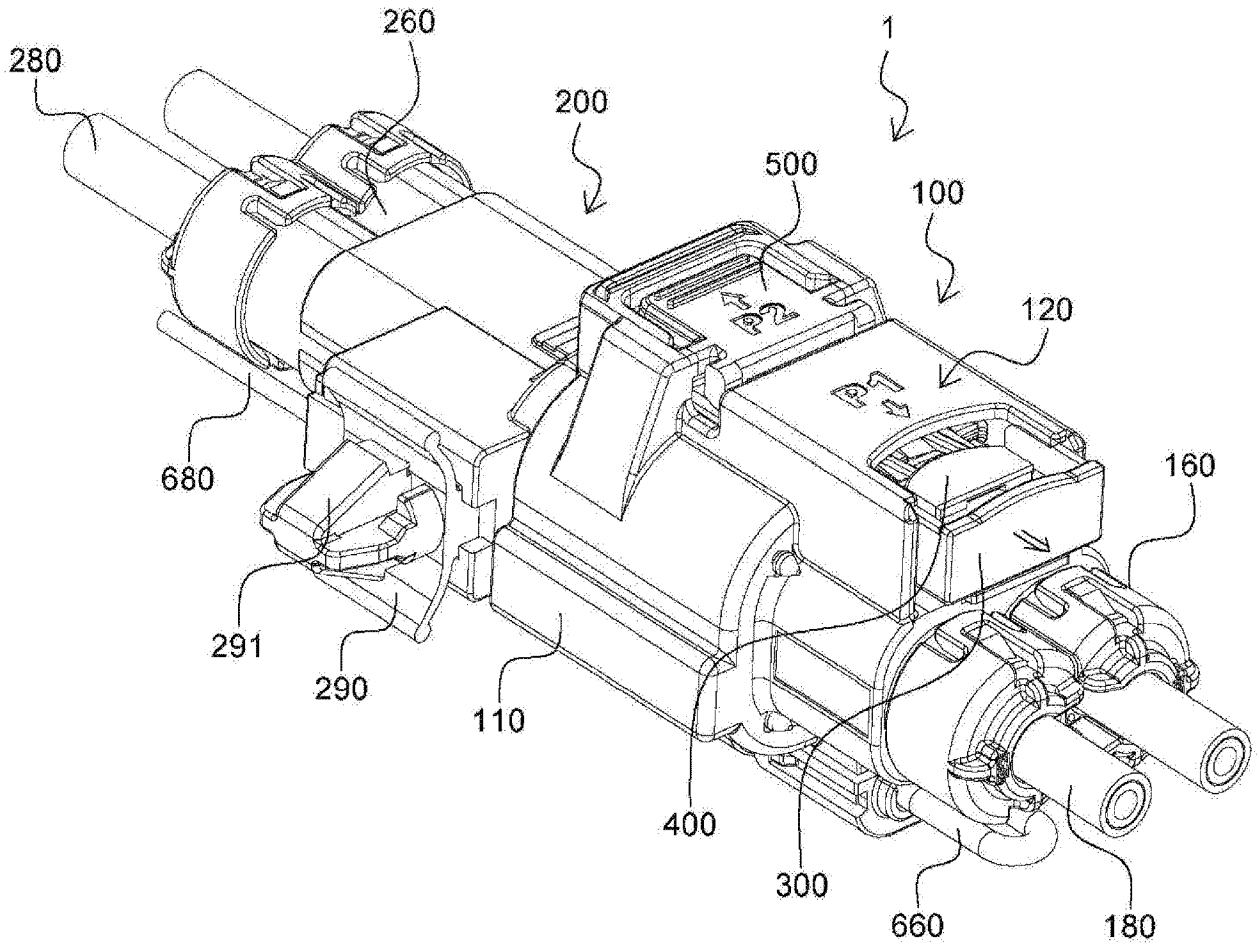
FIG. 5 illustrates a process of releasing a preliminary locked state of a first connector, according to an embodiment of the present invention.

FIG. 4 is a perspective view of a connected state between a first connector 100 and a second connector 200 of a high-voltage power supply connecting device 1 according to an embodiment of the present invention. FIG. 5 illustrates a process of releasing a preliminary locked state of the first connector 100, according to an embodiment of the present invention.

The first connector 100 which is one of the connectors of the high-voltage power supply connecting device 1 according to an embodiment of the present invention may include an interlocking means for selectively locking or unlocking a connection state between interlock terminals, a high-voltage locking means for selectively locking or unlocking a connection state between high-voltage power terminals, and a preliminary locking means for selectively blocking unlocking of the interlocking means.

In detail, FIG. 4 illustrates a locked state of a preliminary locking member 300 of the preliminary locking means while the first connector 100 and the second connector 200 according to an embodiment of the present invention are connected with each other. FIG. 5 illustrates a state in which a preliminary locked state is released as the preliminary locking member 300 is slidingly moved backward while the first connector 100 and the second connector 200 according to an embodiment of the present invention are connected to each other.

As described above, the first connector 100 according to an embodiment of the present invention includes the preliminary locking member 300 configured to be slidingly inserted or pulled out so as to selectively block unlocking of the interlocking means.

Figure 6:
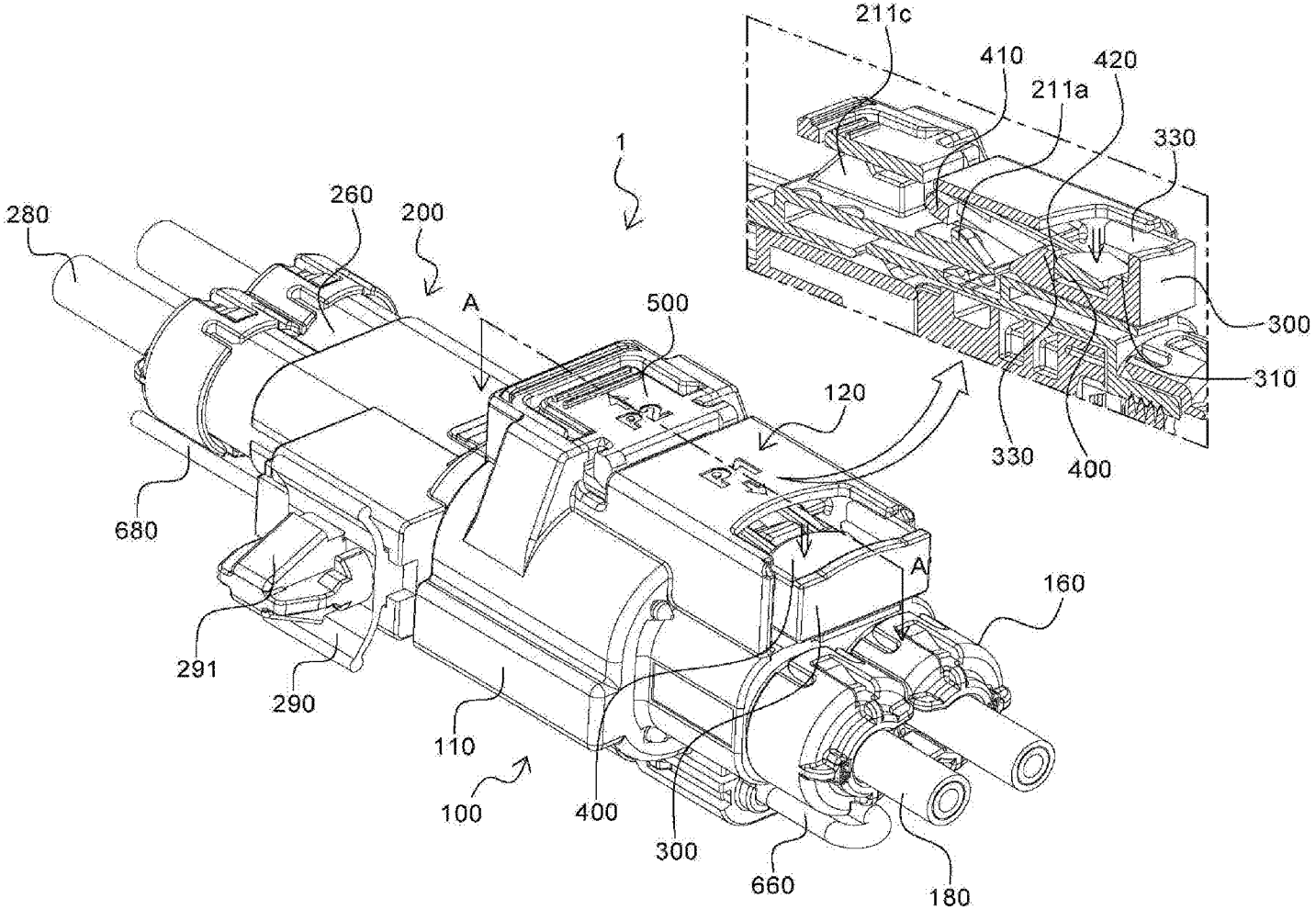
FIGS. 6 and 7 illustrate a process of releasing an interlocked state between a first connector and a second connector, according to embodiments of the present invention.

The interlocking means may include a first locking protrusion 410 of FIG. 6 provided on the first housing 110 and configured to be locked by the first stopper protrusion 211*a* of FIG. 1 provided on a surface of the second housing 210 of the second connector 200 to be connected to the first connector 100; and a first unlocking button 400 for selectively unlocking a locked state between the first locking protrusion 410 and the first stopper protrusion 211*a*. The high-voltage locking means may include a second locking protrusion 510 of FIG. 7 locked by the second stopper protrusion 211*b* of FIG. 1 provided on a surface of the second housing 210 of the second connector 200 to be connected to the first connector 100, and a second unlocking button 500 for selectively unlocking a locked state between the second locking protrusion 510 and the second stopper protrusion 211*b*.

The locking means of the first connector 100 may include the locking protrusion for performing locking when stopped by the stopper protrusion 211*a* or 211*b* of the second connector 200 illustrated in FIG. 1, and the unlocking button 400 or 500 for performing unlocking.

Here, the first locking protrusion 410 and the first unlocking button 400 and the second locking protrusion 510 and the second unlocking button 500 of the interlock means and the high-voltage locking means may be integrally formed with the first housing 110 of the first connector 100, thereby minimizing the number of components of the first connector 100, an assembly man-hour, and the probability of damage (loss).

When components of an interlocking means and a high-voltage locking means are not integrally formed with a housing of a connector as described above, the number of components increases and the components are likely to be lost during maintenance and may be easily damaged due to external shock or the like, thereby increasing costs. Thus, a connector according to the present invention is capable of minimizing manufacturing costs and a probability of a failure and damage of the connector.

In order to disconnect the first connector 100 and the second connector 200 of the high-voltage power supply connecting device 1 of FIG. 3 according to an embodiment of the present invention, a preliminary locked state, an interlock locked state, and a high-voltage locked state should be sequentially released.

Here, the preliminary locked state refers to a locked state for preventing a first locked state from being released due to erroneous pressing of a first unlocking button or the like or from being released by an inexpert operator.

That is, when a high-voltage power supply connecting device provides only interlocking and high-voltage locking released simply by the first and second unlocking buttons 400 and 500, the connectors 100 and 200 may be likely to be erroneously separated by an operator who is inexpert or lacks permission or may be separated when an operator mistakenly presses the unlocking button of each of the connectors. To prevent this problem, a preliminary locking function using a preliminary locking member may be provided to a high-voltage power supply connecting device.

The preliminary locked state may be implemented by the preliminary locking member 300 configured to be slidingly pulled out from or inserted into the manipulation part 120 of the first housing 110 of the first connector 100.

The preliminary locking member 300 may be located below the first unlocking button 400 to prevent downward movement of the first unlocking button 400 of the interlocking means, and may be configured to be inserted to a location at which the downward movement of the first unlocking button 400 is not permitted or to be pulled out to a location at which the downward movement of the first unlocking button 400 is permitted.

The preliminary locking member 300 may be configured such that the first unlocking button 400 cannot be moved downward when the preliminary locking member 300 is inserted below the first unlocking button 400 and can be pressed when the preliminary locking member 300 is pulled output from below the first unlocking button 400.

This function may be implemented such that the preliminary locking member 300 may be slidingly inserted into or pulled out from the manipulation part 120 and the downward movement of the first unlocking button 400 is prevented when the preliminary locking member 300 is inserted into the manipulation part 120 and is permitted when the preliminary locking member 300 is pulled out from the manipulation part 120.

The preliminary locking member 300 should be configured to be slidingly pulled out from or inserted into the manipulation part 120 of the first housing 110 of the first connector 100 but should not be easily separable from the manipulation part 120.

Thus, the preliminary locking member 300 may be separately manufactured and mounted on the manipulation part 120 of the first housing 110 of the first connector 100 but may have an anti-separation structure not to be easily separated from the manipulation part 120, as will be described below.

In the embodiment of FIG. 4, an installation slot (not shown) may be formed in an upper part of the manipulation part 120 of the first housing 110 of the first connector 100, which the preliminary locking member 300 may be slidingly inserted into or pulled out from.

In the preliminary locked state, the preliminary locking member 300 is inserted into the installation slot to prevent downward movement of the first unlocking button 400 even when the first unlocking button 400 is pressed, as illustrated in FIG. 5. In a state illustrated in FIG. 8, the preliminary locking member 300 is pulled out from the installation slot and thus the first unlocking button 400 above the preliminary locking member 300 may be pressed, i.e., may be moved downward when pressed.

That is, in the preliminary locked state illustrated in FIG. 4, the first unlocking button 400 may be prevented from being pressed by a mistake of an operator who is not well-informed of an operating principle of the preliminary locking member 300 or a nonprofessional, inadvertently, out of curiosity or the like.

The preliminary locked state illustrated in FIG. 5 refers to a state, in which the preliminary locking member 300 is pulled out by an operator, i.e., a state in which interlocking can be released.

Here, the state in which interlocking can be released refers to a state in which connection and locking of an interlock terminal are maintained but interlocking can be released by an operator.

And the preliminary locking member 300, the first unlocking button 400, and the second unlocking button 500 are arranged in a line in a direction parallel to the direction in which the preliminary locking member 300 is inserted or the direction in which the preliminary locking member 300 is pulled out. Thus, a skillful operator may sequentially release locking by pulling or pressing the preliminary locking member 300 through minimum movements of his or her fingers, the first unlocking button 400, and the second unlocking button 500 during the disconnection of the connectors 100 and 200.

An operator may sequentially release locking states with his or her hand through the first unlocking button 400 and the second unlocking button 500 without any tools, thereby improving workability.

Figure 7:
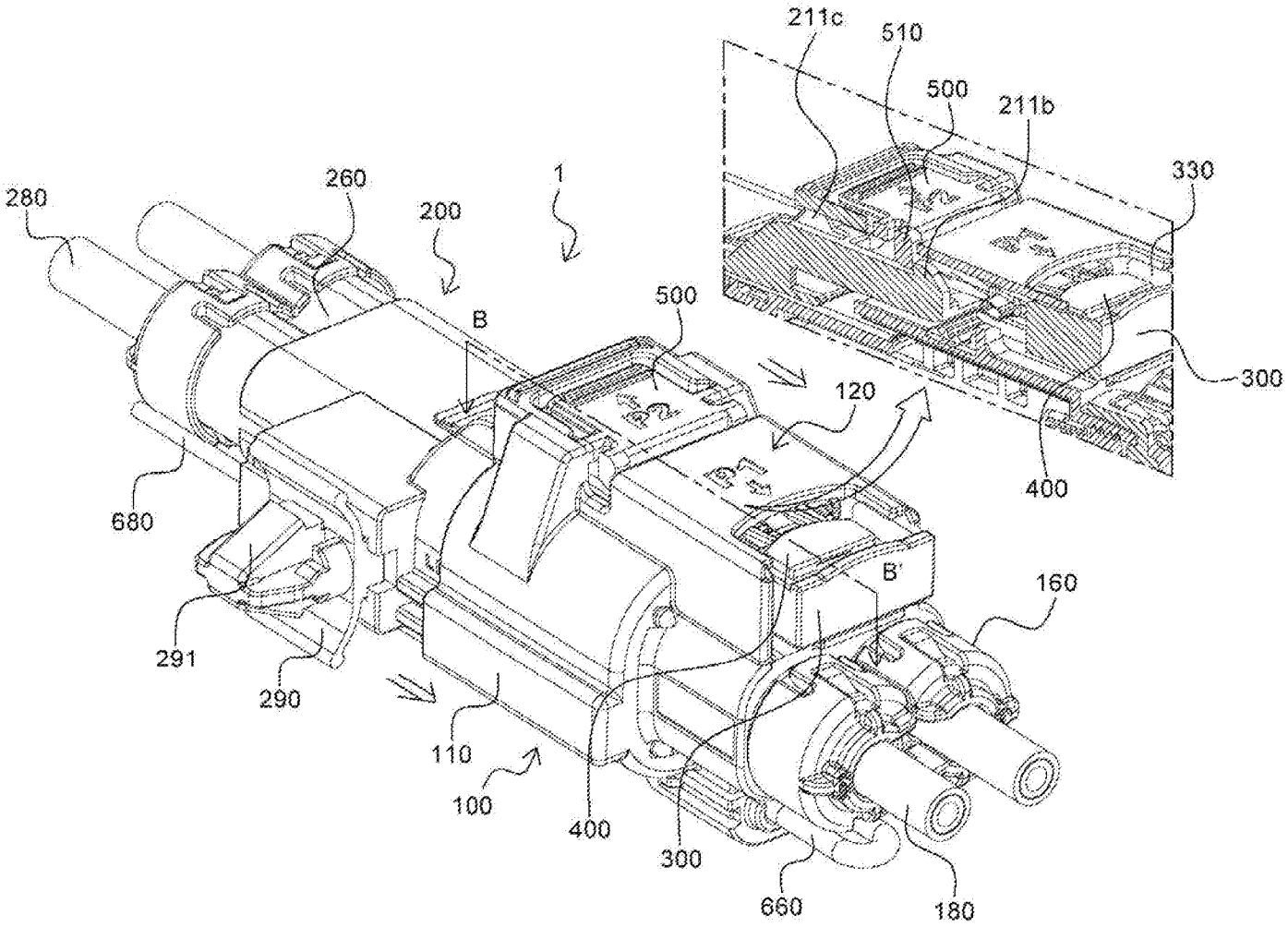

FIGS. 6 and 7 illustrate processes of releasing an interlocked between a first connector and a second connector, according to embodiments of the present invention.

In detail, FIG. 6 illustrates a state in which a preliminary locked state is released by moving backward a preliminary locking member 300 of a first connector 100 of the present invention and an interlocked state is released by pressing the first unlocking button 400, in which an enlarged view taken along line A-A' is shown. FIG. 7 illustrates a high-voltage locked state in which interlock terminals are disconnected from each other by pulling the first connector 100 by a predetermined distance (the distance between of stepped surfaces of locking protrusions of both locking means) after releasing an interlocked state by pressing a first unlocking button 400 while a preliminary locked state is released by moving backward the preliminary locking member 300 of a first connector 100 according to an embodiment of the present invention, in which an enlarged view taken along line B-B' is shown.

As illustrated in FIG. 6, when the preliminary locked state is released by pulling out the preliminary locking member 300, an operator may release an interlocked state by pressing the first unlocking button 400 of the first connector 100 so that the first locking protrusion 410 may be released from the first stopper protrusion 211*a* of the second connector 200 so as to separate the first and second connectors 100 and 200. That is, the first unlocking button 400 of the first connector 100 may lift the first locking protrusion 410 when pressed, according to the principle of lever. That is, the first unlocking button 400 and the first locking protrusion 410 of the first connector 100 may be integrally formed such that when the first unlocking button 400 is pressed, the first locking protrusion 410 may be lifted and unlocked from the first stopper protrusion 211*a*.

A stopper 330 may be formed in a center region of the preliminary locking member 300 and a flange 420 may be formed at a front end of a portion of the first unlocking button 400 to be pressed so as to prevent the preliminary locking member 300 from being completely separated and lost from the manipulation part 120 of the housing 110.

The flange 420 and the stopper 330 may be each formed in an inclined shape not to interrupt the insertion of the preliminary locking member 300 into a slot of the manipulation part 120 or the like. That is, the flange 420 and the stopper 330 may be shaped such that insertion resistance is not high in a direction of the insertion of the preliminary locking member 300 but structural pullout resistance is provided in a direction of pulling out the preliminary locking member 300.

As illustrated in FIG. 7, when the first connector 100 is pulled out from the second connector 200 with the first unlocking button 400 pressed, the interlocked state is released but a high-voltage locked state is entered to prevent the first connector 100 from being pulled out any further.

The high-voltage locked state illustrated in FIG. 7 may involve disconnection of the interlock terminals of the first and second connectors 100 and 200. The disconnection of the interlock terminals leads to blocking of communication and thus a sufficient time may be secured to block the supply of power via high-voltage power terminals.

Thus, as illustrated in FIG. 7, the first connector 100 may be pulled out by a predetermined distance to block communication between the interlock terminals while the high-voltage locked state is maintained. Thus, the supply of power to the high-voltage power terminals may be blocked.

The high-voltage locked state may be implemented by locking the second locking protrusion 510 provided on an end portion of the second unlocking button 500 of the first connector 100 illustrated in FIG. 7 by the second stopper protrusion 211*b* of the second connector 200.

Figure 8:
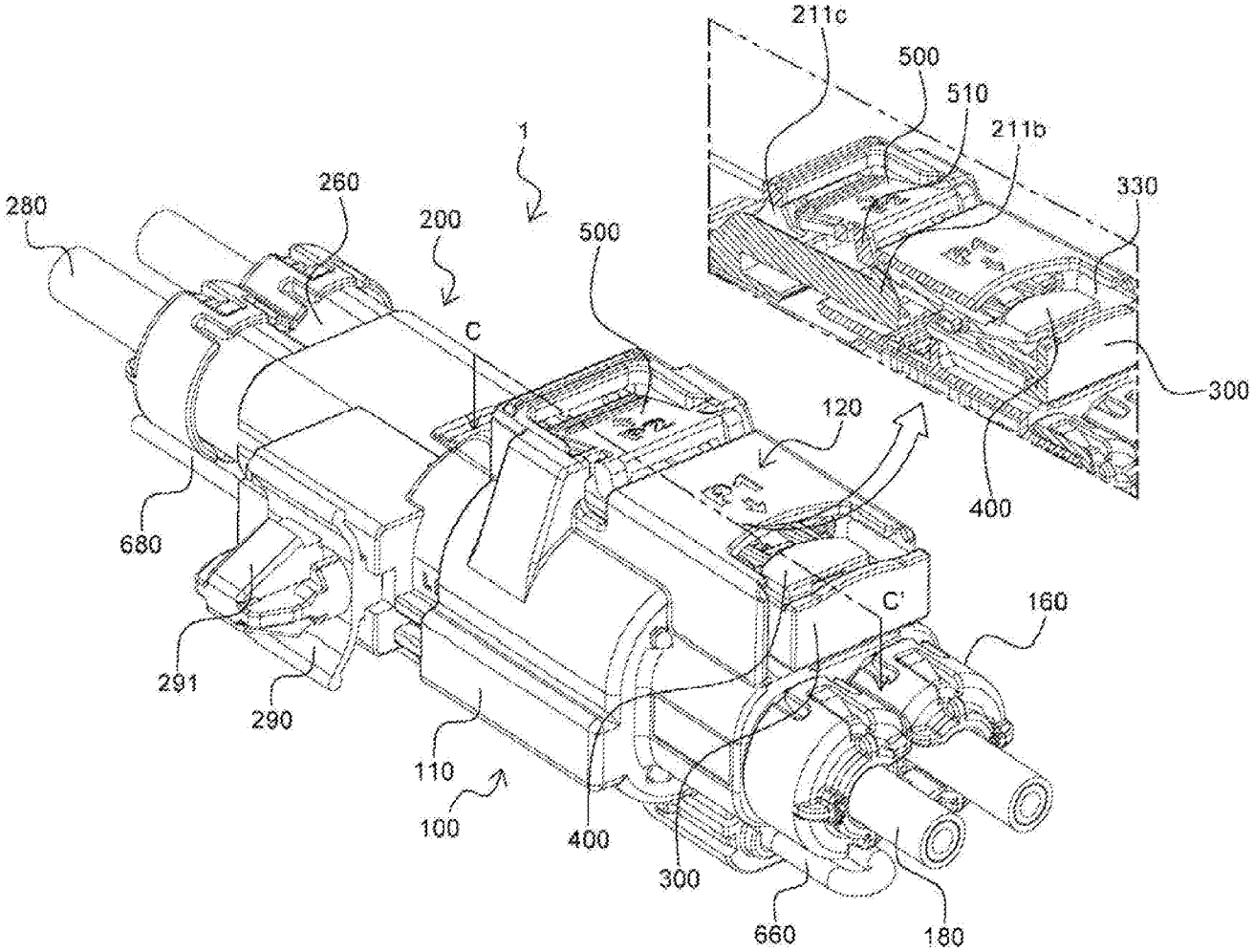
FIG. 8 illustrates a process of releasing a high-voltage locked state between a first connector and a second connector, according to an embodiment of the present invention.

FIG. 8 illustrates a process of releasing a high-voltage locked state between a first connector and a second connector, according to an embodiment of the present invention, in which an enlarged cross-section view taken along line C-C' is shown.

The process of releasing the high-voltage locked state is similar to the process of releasing the interlocked state.

When the second unlocking button 500 is pressed, the second locking protrusion 510 on the end portion of the second unlocking button 500 of the first connector 100 may be displaced and lifted upward while the second locking protrusion 510 is stopped by the second stopper protrusion 211*b* of the second connector 200, thereby releasing the high-voltage locked state.

Similarly, when the second unlocking button 500 is pressed, the second locking protrusion 510 integrally formed with second unlocking button 500 of the first connector 100 may be operated according to the principle of the lever.

Thus, as illustrated in FIG. 8, while the high-voltage locked state is released, an operator may completely separate the first connector 100 from the second connector 200 and the high-voltage power terminals may be disconnected in a state in which the supply of high-voltage power to the high-voltage power terminals is blocked, thereby preventing the occurrence of an electric arc, sparks, or the like.

Figure 9:
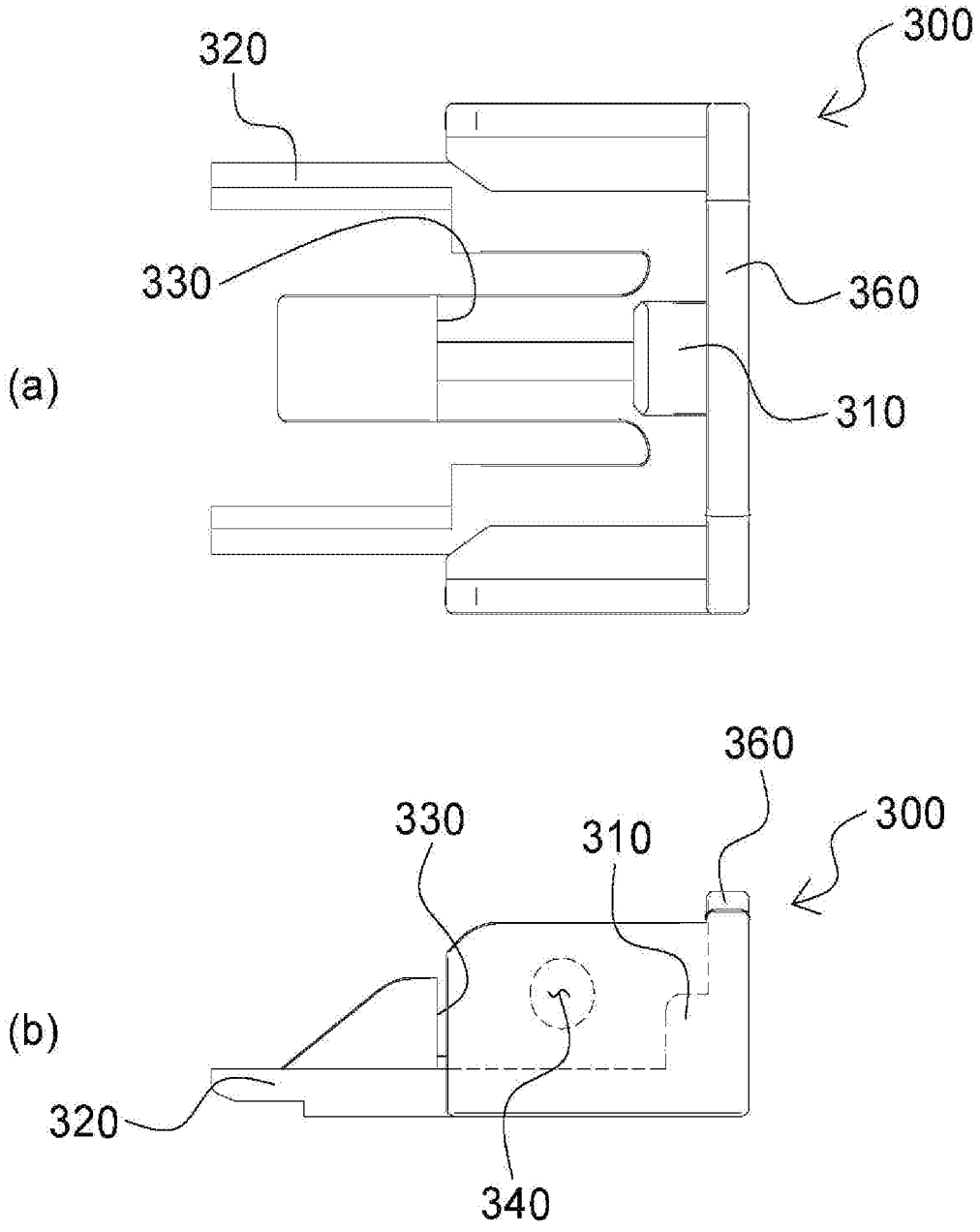
FIG. 9 illustrates a preliminary locking member of a first connector, according to an embodiment of the present invention.

FIG. 9 illustrates a preliminary locking member 300 of a first connector 100, according to an embodiment of the present invention.

In detail, FIG. 9(*a*) is a top view of the preliminary locking member 300 and FIG. 9(*b*) is a side view of the preliminary locking member 300.

The stopper 330 is formed in a barrier form perpendicular to the direction of pulling out the preliminary locking member 300 due to a step in a center region of the preliminary locking member 300. The flange 420 is provided at the front end of the first unlocking button 400. Thus, the preliminary locking member 300 may be prevented from being completely separated from the manipulation part 120 of the first housing 110 and from being pulled out by more than the predetermined distance.

Furthermore, a dent 340 may be provided behind the stopper 330, an uplifted part 310 may be provided behind the dent 340, and a grip part 360 configured to grip the preliminary locking member 300 may be provided on an end part of the preliminary locking member 300 facing the direction of pulling out the preliminary locking member 300 to facilitate the insertion or pulling out of the preliminary locking member 300.

While the preliminary locking member 300 is inserted into the manipulation part 120, the uplifted part 310 is located below the first unlocking button 400 to prevent downward movement of the first unlocking button 400.

The uplifted part 310 may be configured to be located below the first unlocking button 400 during the insertion of the preliminary locking member 300 into the manipulation part 120. The uplifted part 310 may be in a vertical rib form.

The dent 340 is provided to be lower in height than the uplifted part 310 to provide a space for the downward movement of the first unlocking button 400 while the preliminary locking member 300 is pulled out.

Figure 10:
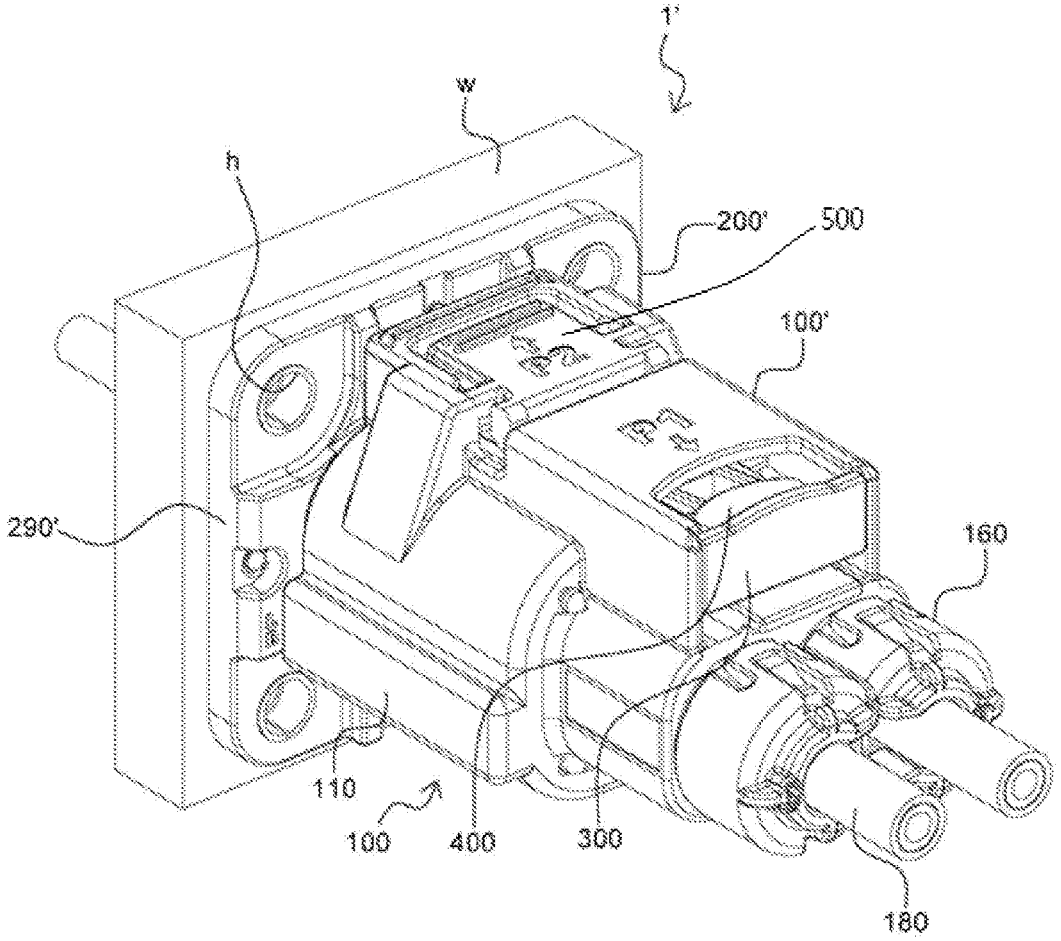
FIG. 10 illustrates a high-voltage power supply connecting device according to another embodiment of the present invention.

FIG. 10 illustrates a high-voltage power supply connecting device 1' according to another embodiment of the present invention.

The connectors 100 and 200 are illustrated as connectors configured for connection of high-voltage cables in the embodiments of FIGS. 1 to 9, whereas a second connector 200' of the high-voltage power supply connecting device 1' of FIG. 10 is illustrated as a connector for installation of an apparatus. That is, the second connector 200' of FIG. 10 may be mounted on an outer wall W of a power supplier or a power demand side.

A fixing unit 290' integrally formed with a housing 210' of the second connector 200' to fix the second connector 200' may be a flange. The fixing unit 290' serving as a flange may include an engagement hole h through which the second connector 200' may be coupled to and fixed onto the outer wall W via a coupling member such as a bolt.

Similarly, in the embodiment of FIG. 10, a preliminary locked state, an interlocked state and a high-voltage locked state are used to guarantee safe separation of a cable. Furthermore, a preliminary locking means, an interlocking means and a high-voltage locking means are employed to release locked states step by step.

Similarly, in the embodiment of FIG. 10, a preliminary locking member 300 is configured to be inserted into or pulled out from a manipulation part provided on an upper part of a first housing 110 of a first connector 100. In the manipulation part 120, a first unlocking button 400 and a second unlocking button 500 are provided in a line to release the interlocked state and the high-voltage locked state. The preliminary locking member 300 is configured to be inserted below the first unlocking button 400. Accordingly, an operator will more intuitively understand a connector separation work and the appearance of the high-voltage power supply connecting device 1' may be simplified.

The manipulation part 120 of the first connector 100 of the high-voltage power supply connecting device 1' according to an embodiment of the present invention is located adjacent to an upper part of the first housing 110 of the first connector 100, so that an operator may easily separate the first connector 100 with one hand. Furthermore, the preliminary locking member 300 is provided to prevent the first connector 100 from being inadvertently or mistakenly separated. That is, the first connector 100 of the high-voltage power supply connecting device 1' according to an embodiment of the present invention may improve both manipulability and safety. Due to the fixing unit 290', the high-voltage power supply connecting device 1' may be stably fixed and installed in an electric equipment space of an electric car.

A connector according to the present invention is capable of minimizing the number of components thereof and the number of components of a high-voltage power supply connecting device including the connector, and is capable of simplifying a locking structure.

The connector according to the present invention may include a preliminary locking member forming a preliminary locking means and is thus capable of being prevented from being inadvertently or mistakenly separated by an operator.

In the connector according to the present invention, the preliminary locking member forming the preliminary locking means is separately manufactured and installed but is configured not to be completely separated from the connector. Thus, a risk of losing the preliminary locking member may be minimized.

In the connector according to the present invention, each of a preliminary locked state, an interlocked state, and a high-voltage locked state may be released only when the other states are released. Accordingly, errors or safety accidents during disconnection of connectors may be minimized.

Furthermore, according to the present invention, a preliminary locking means, an interlocking means, and a high-voltage locking means are arranged in a line. Thus, an operator will intuitively understand a work of disconnecting the connectors from each other and the convenience of the work may be improved.

In addition, according to the present invention, a second connector of the high-voltage power supply connecting device includes a detachable fixing unit. Thus, the high-voltage power supply connecting device may be stably fixed at a desired location in an electric equipment chamber of an electric car which may be continuously leaned to one side and exposed to vibration.

While the present invention has been described above with respect to exemplary embodiments thereof, it would be understood by those skilled in the art that various changes and modifications may be made without departing from the technical conception and scope of the present invention. Thus, it is clear that all modifications are included in the technical scope of the present invention as long as they include the components as claimed in the claims of the present invention.

What is claimed is:

1. A connector which is a component of connectors of a high-voltage power supply connecting device having interlock terminals and high-voltage power terminals and which is one of a pair of connectors to be connected to each other, the connector comprising:

a housing configured to mount therein the high-voltage power terminal;

an interlock connection part provided at an outer side of the housing, and including one of the interlock terminals;

an interlocking means configured to selectively lock or unlock a connection state between interlock terminals of the pair of connectors;

a high-voltage locking means configured to selectively lock or unlock a connection state between high-voltage power terminals of the pair of connectors; and a preliminary locking means configured to selectively block unlocking of the interlocking means, wherein the high-voltage locking means, the interlocking means, and the preliminary locking means are arranged in a line on a manipulation part provided on the housing, and during disconnection of the pair of connectors of the high-voltage power supply connecting device, the interlock terminals are disconnected before disconnection of the high-voltage power terminals, and the supply of power to the high-voltage power terminals is blocked when the interlock terminals are disconnected from each other.

2. The connector of claim 1, wherein the interlock connection part is integrally formed with a bottom surface of the housing.

3. The connector of claim 1, wherein, while the pair of connectors of the high-voltage power supply connecting device are connected to each other, the pair of connectors are separable from each other after a preliminary locked state, an interlocked state, and a high-voltage locked state for the other connector are sequentially released through the preliminary locking means, the interlocking means, and the high-voltage locking means of the connector.

4. The connector of claim 1, wherein the interlocking means comprises:

a first locking protrusion formed in a downward direction, and configured to be locked by a first stopper protrusion protruding upward from a surface of a housing of the other connector to be connected to the connector; and a first unlocking button configured to selectively release a locked state of the first locking protrusion, wherein the first locking protrusion and the first unlocking button are integrally formed with an upper part of the housing of the connector.

5. The connector of claim 4, wherein, while the first unlocking button is pressed, the interlock terminals are disconnected from each other by pulling out the housing of the connector by a predetermined distance in a direction of disconnection of the connector.

6. The connector of claim 5, wherein the high-voltage locking means comprises:

a second locking protrusion formed in a downward direction, and configured to be locked by a second stopper protrusion protruding upward from a surface of the housing of the other connector to be connected to the connector; and a second unlocking button configured to selectively release a locked state of the second locking protrusion, wherein the second locking protrusion and the second unlocking button are integrally formed with the upper part of the housing, and the predetermined distance is a distance between stepped surfaces of the first locking protrusion and the second locking protrusion.

7. The connector of claim 6, wherein, when the first unlocking button or the second unlocking button is pressed, the first locking protrusion locked by the first stopper protrusion or the second locking protrusion locked by the second stopper protrusion is lifted according to the principle of the lever and thus the interlocked state or the high-voltage locked state is released.

8. The connector of claim 4, wherein the preliminary locking means comprises a preliminary locking member located below the first unlocking button of the interlocking means to prevent downward movement of the first unlocking button when the first unlocking button is pressed while the pair of connectors of the high-voltage power supply connecting device are connected to each other, the preliminary locking member configured to be inserted to a location at which the downward movement of the first unlocking button is not permitted or be pulled out to a location at which the downward movement of the first unlocking button is permitted.

9. The connector of claim 8, wherein the preliminary locking member is mounted to be slidingly inserted into or pulled out from an installation slot formed in the upper part of the housing of the connector.

10. The connector of claim 9, further comprising a grip part configured to grip the preliminary locking member during insertion or pulling out of the preliminary locking member, the grip part being formed at an end part of the preliminary locking member facing a direction in which the preliminary locking member is pulled out.

11. The connector of claim 9, wherein the preliminary locking member comprises a stopper at a center region thereof, the stopper being provided in a barrier form with a step facing a direction in which the preliminary locking member is pulled out, and the first unlocking button comprises a flange configured to be stopped by the stopper to prevent the preliminary locking member from being separated from the connector, the flange provided at a front end of a portion of the first unlocking button on which pressure is applied, wherein the stopper and the flange prevent the preliminary locking member from being pulled out by more than a predetermined distance.

12. The connector of claim 11, wherein the preliminary locking member comprises:

a dent behind the stopper; and an uplifted part behind the dent, wherein the uplifted part prevents downward movement of the first unlocking button while the preliminary locking member is inserted, and the dent provides a space for downward movement of the first unlocking button while the preliminary locking member is pulled out.

13. The connector of claim 8, wherein the second unlocking button and the first unlocking button are arranged in a line at a center of the manipulation part in a direction in which the preliminary locking member is inserted or a direction in which the preliminary locking member is pulled out, and the preliminary locking member is inserted or pulled out behind the first unlocking button.

14. A high-voltage power supply connecting device including a pair of connectors, the high-voltage power supply connecting device comprising:

a first connector comprising:

a first interlock terminal;

a first high-voltage power terminal;

a housing configured to mount therein the first high-voltage power terminal;

a first interlock connection part located at an outer side of the housing, and including the first interlock terminal;

an interlocking means configured to selectively lock or unlock a connection state of the first interlock terminal;

a high-voltage locking means configured to selectively lock or unlock a connection state of the first high-voltage power terminal; and a preliminary locking means including a preliminary locking member mounted to slidingly inserted or pulled out so as to selectively block unlocking of the interlocking means; and a second connector comprising:

a second interlock terminal;

a second high-voltage power terminal;

a second housing configured to mount therein the second high-voltage power terminal, the second housing including stopper protrusions configured to lock locking protrusions of the interlocking means and the high-voltage locking means of the first connector;

a fixing unit configured to fix the high-voltage power supply connecting device in an electric equipment space of an electric car, the fixing unit being included in the second housing; and a second interlock connection part located at an outer side of the second housing, and including the second interlock terminal, wherein the high-voltage locking means, the interlocking means, and the preliminary locking means of the first connector are arranged in a line on a manipulation part provided on the housing, and during disconnection of the first and second connectors, the first and second interlock terminals are disconnected from each other before disconnection of the first and second high-voltage power terminals, and the supply of power to the first and second high-voltage power terminals is blocked when the first and second interlock terminals are disconnected from each other.

15. The high-voltage power supply connecting device of claim 14, wherein the first and second interlock connection parts are respectively integrally formed with a bottom surface of the first housing and a bottom surface of the second housing.

16. The high-voltage power supply connecting device of claim 14, wherein, while the first and second connectors are connected to each other, the first and second connectors are separable from each other after a preliminary locked state, an interlocked state, and a high-voltage locked state for the second connector are sequentially released through the preliminary locking means, the interlocking means, and the high-voltage locking means of the first connector.

17. The high-voltage power supply connecting device of claim 14, wherein the fixing unit of the second connector comprises a fixing clip configured to be attachable to or detachable from the second housing.

18. The high-voltage power supply connecting device of claim 17, wherein the fixing clip is mounted on a side surface of the second housing.

* * * * *